US006661993B2

(12) United States Patent
Bartscher et al.

(10) Patent No.: US 6,661,993 B2
(45) Date of Patent: Dec. 9, 2003

(54) PROCESS FOR CONTROLLING THE GLOSS OF A TONER IMAGE AND A DIGITAL IMAGE RECORDING DEVICE

(75) Inventors: Gerhard Bartscher, Köln (DE); Frank-Michael Morgenweck, Molfsee (DE); Domingo Rohde, Kiel (DE); Muhammed Aslam, Rochester, NY (US)

(73) Assignee: Nexpress Solutions LLC

( * ) Notice: Subject to any disclaimer, the term of this patent is extended or adjusted under 35 U.S.C. 154(b) by 0 days.

(21) Appl. No.: 10/028,037

(22) Filed: Dec. 20, 2001

(65) Prior Publication Data

US 2002/0094220 A1 Jul. 18, 2002

(30) Foreign Application Priority Data

Dec. 22, 2000 (DE) ..... 100 64 566

(51) Int. Cl.[7] ..... G03G 15/20
(52) U.S. Cl. ..... 399/341; 399/69; 399/328
(58) Field of Search ..... 219/216; 399/67, 399/69, 328, 330, 331, 333, 335, 336, 337

(56) References Cited

U.S. PATENT DOCUMENTS 5,004,891 A 4/1991 Landis
5,436,710 A * 7/1995 Uchiyama ..... 399/336
5,602,635 A * 2/1997 Domoto et al. ..... 399/328
5,805,969 A * 9/1998 Elsermans et al. ..... 399/341
6,101,345 A 8/2000 VanGoethem et al.
6,120,960 A 9/2000 Aoki et al.

FOREIGN PATENT DOCUMENTS

DE 198 57 229 A1 7/1999
DE 199 54 953 A1 5/2000

* cited by examiner

*Primary Examiner*—Hoang Ngo
(74) *Attorney, Agent, or Firm*—Lawrence P. Kessler

(57) ABSTRACT

A digital image recording device (1), especially an electrographic or electrophotographic printing or copying machine, and a process for controlling the gloss of a toner image which has been transferred to an image carrier substrate (9) and fixed are proposed. In the process, after the toner image has been fixed on the image carrier substrate (9) by heating, as much heat is supplied to the toner image at least once again that the toner image on its surface or in the area near its surface is melted either completely or at least in areas, the degree and/or the duration of melting being set depending on the desired gloss of the toner image.

11 Claims, 1 Drawing Sheet

PROCESS FOR CONTROLLING THE GLOSS OF A TONER IMAGE AND A DIGITAL IMAGE RECORDING DEVICE

FIELD OF THE INVENTION

The invention relates to a process for controlling the gloss of a toner image which has been transferred to an image carrier substrate and fixed, wherein the degree and/or the duration of melting is set depending on the desired gloss of the toner image.

BACKGROUND OF THE INVENTION

A known digital image recording process is electrostatic printing in which a latent electrostatic image is developed by charged toner particles. They are transferred to an image receiver substrate, hereinafter simply a substrate. Then the developed image, which has been transferred to the substrate, is fixed by melting on the toner particles by supplying heat.

Often dry toners are used having particles with an average diameter of 10 microns. To melt the toner particles onto the substrate, hot rollers are often used which are brought into contact with the toner image. The disadvantage here is that a separating agent, for example silicone oil, is necessary to prevent the toner image from sticking to the roller. For a four-color image at least three toner layers are applied in succession to the image carrier substrate, each of the toner layers consisting of a polymer material can have a thickness of 30 microns. The gloss of these toner layers, which is very important for image quality, is determined by many factors, for example by the surface structure of the hot rollers, the fixing temperature and the toner properties.

In another known process, instead of hot rollers, a heated belt is used to melt the toner image. A high gloss can be achieved with this process. Since the belt is heated over a certain length, the toner image, after it has passed the heated area, can cool and become hard before it is separated from the previously hot surface of the belt. This enables simple and reliable separation of the toner image from the belt. The structure of the toner image surface is through the melting identical with the surface of the belt. In order to achieve a very smooth toner surface that goes along with high gloss, therefore, a very smooth belt must be used.

High gloss of the toner image is not necessary for all applications. For example, in an image carrier substrate formed by matt paper, only low gloss of the toner image is necessary. One possibility for changing the gloss is to use only a few heated rollers with a defined surface roughness. The rollers touch the surface of the toner image and imprint their surface structure into the toner image. In order to change the roughness of the toner image and thus its gloss in this process, therefore rollers with different roughness must be used. Another defect of the hot rollers is that they are subject to wear and after a certain time must be replaced; this is costly. Mechanical contact between the toner image and the image carrier substrate and the rollers furthermore leads to the toner image often sticking to the outside jacket surface of the rollers. In most cases therefore a cleaning system for the rollers is necessary.

SUMMARY OF THE INVENTION

The object of the invention is to devise a process for controlling the gloss of a toner image which has been transferred to an image carrier substrate and fixed, in which it is possible to influence the toner image gloss in a controlled manner, preferably cheaply and easily. Another objective of the invention is to devise a digital image-recording device in which a desired toner image gloss can be precisely set. In addition, the costs of the image-recording device should preferably be low.

To achieve this object, a process is proposed in which first the toner image is transferred in the conventional manner to the image carrier substrate and fixed on it, and only afterwards in a second step either completely, or at least in areas, melted to its surface or in a region near its surface. This is done according to the invention in that heat is supplied to the already fixed toner image at least one more time; this takes place, preferably without contact, by a radiation source. The melting of the toner image fixed on the image carrier substrate on its surface leads to the liquid toner beginning to deliquesce so that it has a very smooth surface and thus high gloss when it has completely deliquesced. The toner image gloss can be precisely influenced by the degree of melting, therefore to the extent that the toner image is melted its surface, and by the duration of melting, therefore how long the toner image is kept in the liquid state so that it can deliquesce. The already fixed toner image need not be completely melted again to influence its gloss, but only its uppermost layer, so that the energy to be expended for this purpose is only low. It is especially advantageous in the process according to the invention that essentially any gloss increment can be set; that is, flat to high gloss, without the need to replace parts of the fixing device each time.

If the fixing device for first-time fixing of the toner image on the image carrier substrate has a heater with at least one hot roller, this hot roller can be used for first-time fixing of almost all toner images, regardless of what gloss the respective toner image is to have when it is completed. If the gloss of the toner image fixed by the hot rollers on the image carrier substrate is to be changed, in a second step the surface of the toner image is re-treated in the desired manner, therefore melted and then cooled again so that depending on how high the degree of melting is and the interval for which the toner image is kept in the liquid phase, the toner image then has a gloss which is greater or reduced compared to the initial state.

The re-heating of the already fixed toner image takes place preferably using a heating/melting process which works without contact. The advantages of the process of the invention of course arise when the actual fixing of the toner image on the image carrier substrate takes place by radiation instead of using hot rollers, therefore without contact, since the radiation exposes the toner image only to electromagnetic radiation and is not brought into mechanical contact with the toner image. Here, in the following processing step, the gloss of the toner image already fixed on the image carrier substrate is also adjusted by a preferably non-contact heating process.

The "degree" of re-melting of the surface of the toner image already fixed on the image carrier substrate can be up to 100%. In this case the toner image surface is completely melted and can deliquesce so that a very smooth surface, and thus a very high gloss, result. The degree of melting can also be less than 100%, i.e. the surface of the toner layer is only partially melted, so that the parts of this toner image still in the solid state are in a "melt". When this state of the toner image is frozen, for example by the toner image being rapidly cooled, a toner surface with a certain roughness and thus with a correspondingly lower gloss than in a smoother toner image surface results.

In one advantageous embodiment of the process, it is provided that the toner image is exposed to two successive electromagnetic radiation pulses, and the duration of the first radiation pulse can be longer than the second radiation pulse. In conjunction with this invention a "radiation pulse" is defined as a flash of light which acts only briefly on the toner image. The radiation of the light flash is in a certain, preferably adjustable wavelength range, especially in the UV range. The first radiation pulse can be very short for example and can have a very high energy intensity so that the surface of the toner image is melted, while by the second, preferably very short radiation pulse, the gloss of the toner image surface is reduced. The intensity of the two radiation pulses can therefore be varied to influence the gloss. A high intensity of at least the first radiation pulse can therefore lead first of all to a high gloss, and this gloss can be changed in a controlled manner by the second radiation pulse.

According to one development of the invention, it is provided that the toner image is fixed by a heater which makes mechanical contact with the toner image and that in a subsequent processing step the fixed toner image is exposed to electromagnetic radiation or several radiation pulses. The toner image has areas of varied gloss due to the fixing of the toner by at least one element which comes into contact with the toner image, for example a hot roller or a heatable strip. By exposing the toner image to cycled or continuous electromagnetic radiation, the gloss in the areas of the toner image with a higher toner density is more dramatically reduced than in the areas with lower toner density. The reason for this is that a toner image with higher density absorbs electromagnetic radiation better. Based on the differing gloss reduction which depends on the toner densities, a uniform gloss can be adjusted over the entire toner image.

In one especially advantageous embodiment, to influence the gloss of the toner image fixed on the image carrier substrate, the image is exposed to pulsed or continuous electromagnetic radiation in the UV range. In this wavelength range the radiation is essentially uniformly absorbed by the color toners, while for example the image carrier substrate consisting of paper absorbs only very little radiation in the UV range. The limited wavelength range of the radiation can therefore ensure that the paper is not damaged by this radiation which can have high intensity. Often radiation sources are used which do not emit radiation exclusively in the UV range, but also in the visible range in which the color toners which have different colors (blue, magenta, black, yellow, or mixed colors) absorb the radiation to different degrees. In the visible wavelength range, the paper absorbs the radiation very efficiently so that, at high radiation intensity, damage to the paper cannot be precluded. It is provided for this purpose that the electromagnetic radiation is filtered such that the toner image is exposed only to radiation in the UV range.

One embodiment of the process is also preferred in which the toner image is exposed to several successive electromagnetic radiation pulses, the duration and/or the intensity of the radiation pulses being of varied length and high. According to a first embodiment, it is provided that each of the radiation pulses has enough energy to heat the toner image, or the area of the toner image near the surface, such that it melts and the toner can deliquesce. According to another embodiment it is provided that the energy of each individual radiation pulse is not enough to melt the toner and that the toner image is only melted when it has been exposed to several radiation pulses. Each individual radiation pulse can therefore deliver only part of the total amount of energy to the toner which is necessary to melt the toner. In one advantageous embodiment, the energy of each radiation pulse is the same. According to another embodiment, it is provided that the first radiation pulse has the greatest energy and the energy of each additional radiation pulse is less than that of the preceding radiation pulse.

In one advantageous embodiment, it is provided that at least two successive radiation pulses are applied in succession to the toner image. There is therefore a pause between the radiation pulses so that the heat delivered into the toner image by the first radiation pulse can disperse before the second radiation pulse is applied to the toner image.

In one advantageous embodiment of the process three radiation pulses with an energy of 0.5 J/cm$^2$ lasting 0.5 ms and a pause of 5 ms between two successive radiation pulses are applied to the toner image. The first radiation pulse in the area of the toner image near the surface heats one toner layer with a thickness of roughly 3 microns; this leads to limited smoothing of the toner surface. After roughly 1 ms, the at least partially liquefied toner layer passes into the solid state, and roughly 5 ms after the first radiation pulse, most of the heat has dispersed in the toner image. Then the second radiation pulse is applied to the toner image; it has enough energy to re-melt the uppermost toner layer, and then the third radiation pulse which optionally melts the toner layer once more. Still other radiation pulses can be applied to the toner image, if necessary. It is important that to achieve high gloss the uppermost toner layer is heated long enough to a high enough temperature that this toner layer glazes to the desired degree and thus a high gloss forms.

In the aforementioned embodiments of the process, the energy of each individual radiation pulse is only so great that damage to the toner image due to overheating of the toner, which leads to thickening or oxidation of the toner material, is prevented.

In another embodiment of the process it is provided that at least one, preferably several short, low-energy radiation pulses are applied to the toner image. "Short" means a duration of less than 0.5 ms and "low-energy" means an energy of less than 0.5 J/cm$^2$, preferably with a pause between two successive radiation pulses.

Furthermore, an embodiment of the process is preferable in which the toner image in a first processing step is melted to such an extent that a relatively high gloss results and that in a following, second processing step, the toner image is exposed to so much thermal energy that at least parts of the toner material, especially the surface layer of the toner image, are overheated and thus damaged in a controlled manner. Overheating vaporizes the toner material or oxidation takes place; in both cases this leads to a rougher surface and thus to reduced gloss. The degree of damage to the toner image surface can be influenced in a controlled manner by various measures. A first possibility is to heat a very thin toner layer of the toner image near the surface, resulting in stresses in this toner layer which lead to wrinkling or undulation of the toner image surface. In this way, the surface becomes uneven or rough; this reduces gloss. Another possibility is to heat the entire toner image while the image carrier substrate, which is for example paper, remains cold and optionally is cooled for this purpose. Due to the excess heating of the toner material, bubbles form in the toner image, which in turn allow the surface roughness of the toner image to rise. In this version, to control the toner image gloss, the color saturation stage can be reduced, and the effect on the color saturation stage can be minimized by controlled process guidance.

To achieve the object, an image recording device is furthermore proposed including a fixing device for fixing a toner image on an image carrier substrate, the fixing device having at least one roller over which the image carrier substrate is guided. The image recording device is characterized in that the roller of the fixing device is made drum-shaped and at least its jacket has transparent material, and that within the roller there is a radiation source for exposing the toner image to electromagnetic radiation for purposes of fixing the toner image on the substrate. The radiation source located within the roller, therefore selectively makes available the energy necessary to melt the upper toner layer or the entire toner image, while the image carrier substrate with the toner image located on it adjoins the outside jacket of the roller. The device is compact and space-saving in construction. The device according to the invention can also be reliably used at high process speeds. The device can be used both for first-time fixing of the toner image on the image carrier substrate and also for setting the gloss of a toner image which has already been fixed on the image carrier substrate in a preceding step.

According to one development of the invention, it is provided that the radiation source emits electromagnetic radiation and/or radiation pulses with a wavelength range chosen such that they penetrate the jacket of the roller, at least for the most part. The cycled or continuous radiation is therefore not absorbed by the material of the roller jacket so that the roller is at least largely not heated. Therefore the radiation heats only the toner image adjoining the outside jacket surface of the roller.

In one preferred embodiment, the toner image is exposed to at least one radiation pulse which is shorter than the contact time between the roller and the toner image. The energy of the radiation pulse preferably heats only the uppermost toner layer of the toner image which thus at least partially melts so that the structure of the outside jacket of the roller is impressed on the toner image. The roller, the unmelted part of the toner image, and the image carrier substrate then cool the heated uppermost toner layer to below its glass temperature Tg within a very short time. This time is shorter than the contact time between the toner image and the roller. The previously liquefied toner layer therefore passes into a solid state before the toner image together with the substrate is lifted from the outside jacket of the roller. One important advantage is that due to the solid toner, separation between the toner image and the roller is easily possible without the toner sticking to the roller. It may therefore be possible to do away with a separating agent. Because the melted upper toner layer of the toner image adjoins the outside jacket surface of the roller, its structure is more or less imprinted into the toner image. Advantageously this yields the possibility of setting the desired gloss of the toner image by using a roller with an outside jacket which has a corresponding roughness.

In one preferred embodiment the roller or the jacket of the roller includes a material which has high thermal conductivity. This has the advantage that the toner can be cooled very quickly so that good separation of the toner image from the roller is achieved and the toner image can be prevented from sticking to the roller, preferably without the aid of a separating agent. In one advantageous embodiment the fixing roller is quartz glass.

BRIEF DESCRIPTION OF THE DRAWINGS

The invention is detailed below using the accompanying drawings in which.

DETAILED DESCRIPTION OF THE INVENTION

The image recording device described below can be used, in general, as a printing or copying machine which works using the electrographic or electrophotographic process, for example. Image recording devices of the type addressed here are basically known so that their structure and function are not detailed here. In conjunction with this invention the expression "image carrier substrate" is defined as all articles and materials on which a liquid or dry toner, preferably smudge-proof, can be fixed. The image carrier substrate can for example be a sheet of paper or a paper web.

Figure 1:
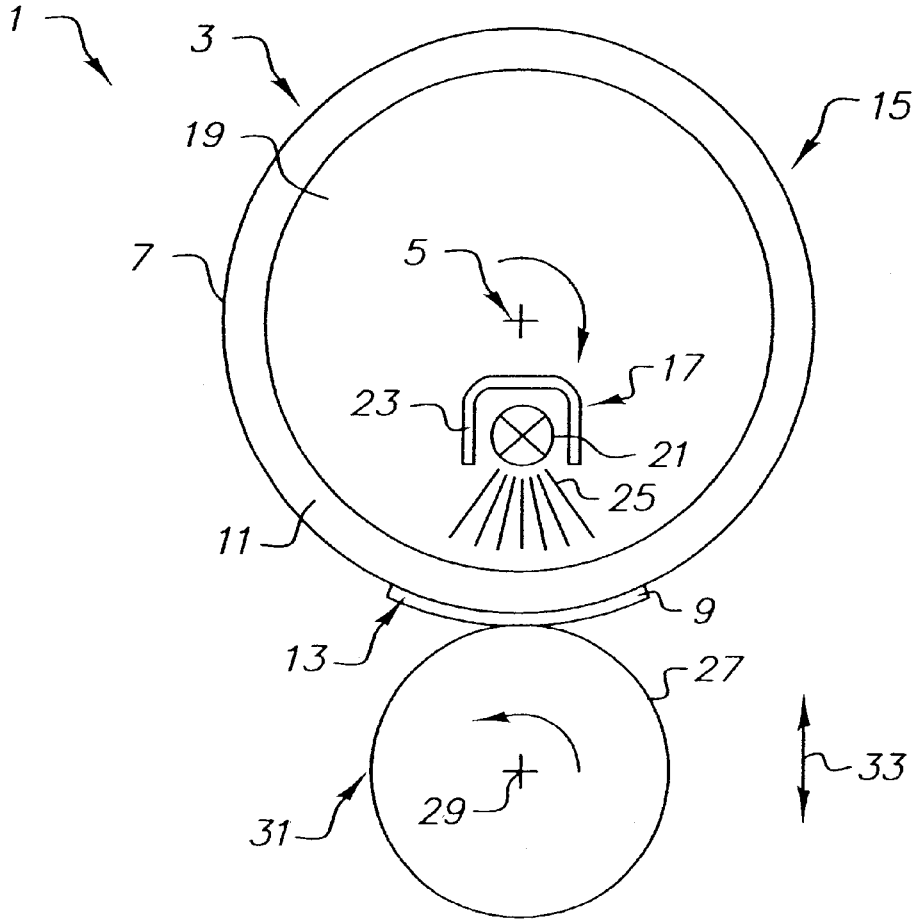
FIG. 1 shows a side view of one embodiment of the image recording device as claimed in the invention.

FIG. 1 shows a portion of one embodiment of the image recording device 1, specifically a fixing device 3 which includes a roller 7 which can be driven to turn around an axis 5. Using a transport, which is not shown, an arc-shaped image carrier substrate 9 is guided onto the outside of the jacket 11 of the roller. The image carrier substrate 9 with its flat side 13, which has a toner image which is not shown, adjoins the outside jacket surface 15 of the roller 7. The image carrier substrate 9 is guided by rotation of the roller 7 from an acceptance area into a transfer area past the radiation source 17 to influence or control the gloss of the toner image on the image carrier substrate 9.

The jacket 11 of the roller 7 includes a transparent, therefore translucent material which preferably has high thermal conductivity. Alternatively, the jacket 11 can be made of quartz glass. The roller 7 can be sealed on its end faces by covers which are not shown.

The radiation source 17 is located stationary in the interior 19 of the roller 7, i.e. while the radiation source 17 is in a constant position the jacket 11 of the roller 7 is moving relative to the radiation source 17. The radiation source 17 has a light source 21 which is formed for example by a xenon flash lamp, xenon-mercury flash lamp, a laser or the like. The light source 21 here is located for example on a deflector 23 which has an opening toward the fixing area.

As is apparent from FIG. 1, when the light source 21 is turned on, the image carrier substrate 9 which adjoins the outside jacket surface 15 of the roller 7 is exposed to electromagnetic radiation 25 which penetrates, at least for the most part, the translucent jacket 11 and heats the toner image which adjoins the outside jacket surface 15 of the roller 7 and which is located on the flat side 13 of the image carrier substrate 9. Only a small part, if any, of the electromagnetic radiation is absorbed by the roller 7 due to the jacket 11 which consists of translucent material. The radiation source 17 is made such that the electromagnetic radiation 25 is applied by being cycled, which is called a radiation pulse below, or continuously onto the image carrier substrate 9. To produce radiation pulses, which are also called light flashes, a constantly shining light source can also be used when there are for example openable and closable flaps or shutters located in the radiation path between the light source and the toner image.

The light source 21 is preferably made such that it emits only radiation in the UV range. If the light source 21 emits, besides radiation in the UV range, also for example in the visible infrared range, a radiation filter can be used which is located in the radiation path between the light source and the toner image and which filters the radiation emitted by the light source so that only radiation in the UV range strikes the toner image.

The fixing device 3 furthermore has a pressure roller 27 which is made to be able to rotate around an axis 29. At least the outside jacket 31 of the pressure roller 27 includes a flexible, especially soft and deformable material. The pressure roller 27 can be displaced in the direction of the outside jacket surface 15 of the roller by an actuator which is not shown, as indicated by the double arrow 33. The pressure roller 27 can be pressed with an adjustable force against the outside jacket surface 15 of the roller 7. By pressure, the outside jacket surface 31 of the pressure roller 27 is more or less flattened due to its flexibility and over a certain peripheral area of the roller rests against its outside jacket surface 15. In this way a nip is formed which is, for example, 5 mm long and which guides the image carrier substrate 9. The pressure roller 27 presses the toner image which is at least partially melted by the radiation source 17 on the flat side 13 of the image carrier substrate 9 against the outside jacket surface 15 of the roller 7. The toner image has already been fixed on the image carrier substrate 9 in a previous process step before it is routed past the radiation source 17.

Using a control which is not shown, the contact pressure of the pressure roller 27 on the roller 7, the peripheral speed of the roller 7, and the duration of the action of the electromagnetic radiation 25 on the toner image and its intensity are adjustable.

The process according to the invention follows easily from the description for FIG. 1. This calls for, after the toner image has been fixed by heating on the image carrier substrate 9, as much heat is supplied to the toner image at least once again that the toner image on its surface or in the area near its surface is melted either completely or at least in areas. This takes place in the embodiment as shown in FIG. 1 using the radiation source 17, while the image carrier substrate 9 adjoins its outside jacket surfaces 15 or is pressed with a defined force by the pressure roller against it. The degree and/or the duration of melting is set according to the invention depending on the desired gloss of the toner image. By melting the uppermost toner layer of the toner image with simultaneous pressure of the image carrier substrate 9 on the outside jacket surface 15 of the roller 7 the structure of the outside jacket surface 15 is more or less impressed into the at least partially liquefied toner image 9. Since the gloss of the toner image is determined largely by the roughness of the toner image on its surface, the gloss of the toner image is therefore determined by the structure or the surface roughness of the outside jacket surface 15 of the roller 7. If the toner image is to acquire a high gloss, the outside jacket surface 15 of the roller 7, must be correspondingly smooth, while for a less glossy, for example flat toner image, the outside jacket surface 15 has a corresponding roughness.

Since the uppermost toner layer of the toner image is melted using the radiation source 17, the toner image cools within a very short time to such an extent that it passes completely into a solid state before the image carrier substrate 9 is lifted off the roller 7 and transferred to the following part of the device 1. The liquefied layer of the toner image near the surface is cooled by the underlying solid toner layer, the image carrier substrate 9 and by the roller 7.

Figure 2:
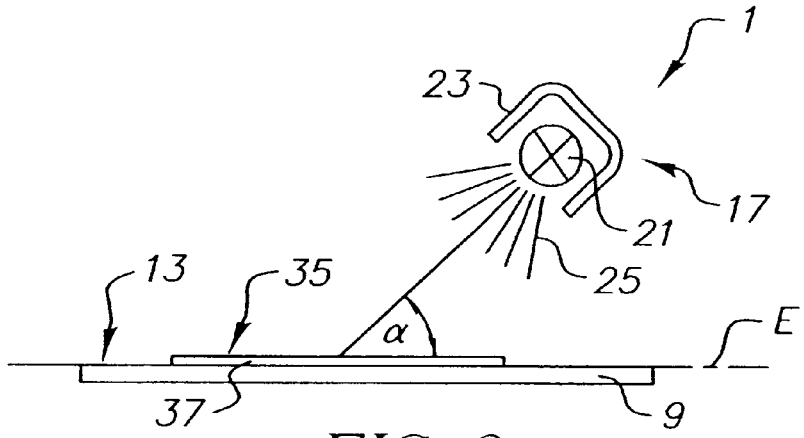
FIG. 2 shows another embodiment of a radiation source for fixing the toner image on an image carrier substrate.

FIG. 2 shows in a schematic, another embodiment, of the image recording device 1, specifically a radiation source 17, as is described using FIG. 1. The radiation source 17 has a constant fixed position within the image recording device 1. The image carrier substrate 9 is routed past the radiation source 17 by a transport which is not shown. An imaginary transport plane E in which the image carrier substrate 9 is located is indicated with a broken line. The radiation source 17 as claimed in the invention is made and aligned relative to the transport plane E such that the electromagnetic radiation 25 or the radiation pulses (light flashes) strike, the surface 35 of the toner image 37 which has already been fixed and which has been applied to the flat side 13 of the image carrier substrate 9; at an angle $\alpha$, this angle is less than 90°. It has been shown that an oblique angle of incidence of the electromagnetic radiation 25 on the toner image surface 35 leads to higher energy delivery to the toner image 37 than if the electromagnetic radiation 23 were vertically incident on the toner image surface 35. Here the efficiency of energy delivery rises by a factor of $1/\sin(\alpha)$. The angle of incidence $\alpha$, however, cannot be small since starting from a certain threshold, the reflection of electromagnetic radiation 25 increases.

In summary, it remains that the fixing device 3 described using FIGS. 1 and 2 due to its configuration and function can be easily used selectively for first-time fixing of a toner image which has been transferred to the image carrier substrate and for influencing or controlling the gloss of a toner image which has already been fixed on the image carrier substrate in a previous process step. In other words, the fixing device 3 can therefore be used for first-time melting of the toner image and also alternatively for influencing the uppermost toner layer of the already fixed toner image in a controlled manner for purposes of influencing the gloss of the toner image as desired.

The embodiments should not be understood as a limitation of the invention. Rather, within the framework of this disclosure numerous modifications and changes are possible, especially those versions, elements and combinations and/or materials which for example by combination or modification can be taken from individual features or elements for process steps which are contained in the drawings and which are described in the general specification and embodiments and the claims, for one skilled in the art with respect to achieving the object, and lead to a new subject matter or new process steps or sequences of process steps by combinable features.

The invention has been described in detail with particular reference to certain preferred embodiments thereof, but it will be understood that variations and modifications can be effected within the spirit and scope of the invention.

PARTS LIST

1 image recording device
3 fixing device
5 axis
7 roller
9 image carrier substrate
11 jacket
13 flat side
15 outside jacket surface
17 radiation source
19 interior
21 light source
23 deflector
25 radiation
27 pressure roller
29 axis
31 outside jacket surface
33 double arrow
35 surface
37 toner image

What is claimed is:

1. Process for controlling the gloss of a toner image which has been transferred to an image carrier substrate (9) and fixed, comprising the steps:

the toner image is melted, by a heater which makes mechanical contact with the toner image, to such an extent that a relatively high gloss results; and after the toner image has been fixed on the image carrier substrate (9) by heating, the toner image is exposed to so much thermal energy by electromagnetic radiation or several radiation pulses that at least parts of the toner material, especially the surface layer of the toner image, are overheated and thus damaged in a controlled manner, as much heat being supplied to the toner image at least once again that the toner image on its surface or in the area near its surface is melted either completely or at least in areas, the degree and/or the duration of melting being set depending on the desired gloss of the toner image.

2. Process as claimed in claim 1, wherein the image carrier substrate (9) is guided via a transparent roller (7) which has a radiation source (17) in its interior (19), the already fixed toner image adjoining the outside jacket surface (15) of the roller (7), and wherein the toner image is exposed by the radiation source (17) to electromagnetic radiation (25) and/or several radiation pulses (25).

3. Process as claimed in claim 2, wherein the image carrier substrate (9) is pressed against the outside jacket surface (15) of the roller (7) with defined force.

4. Process as claimed in claim 3, wherein the length of irradiation and/or pressure of the image carrier substrate (9) against the roller (7) can be adjusted.

5. Process as claimed in claim 4, wherein the toner image is exposed to several successive electromagnetic radiation pulses, the duration and/or the intensity of the radiation pulses being of different length or magnitude.

6. Process as claimed in claim 5, wherein at least two successive radiation pulses are applied in succession to the toner image.

7. Process as claimed in claim 5, wherein the energy and/or duration of each individual radiation pulse is so low that the desired melting of the toner image takes place only when all radiation pulses have been applied to the toner image.

8. Process as claimed in claim 1, wherein the electromagnetic radiation (25) which has been applied continuously or in the form of pulses to the toner image strikes the toner image surface at an angle ($\alpha$) which is less than 90°.

9. Process as claimed in claim 1, wherein the pulsed or continuous electromagnetic radiation to which the toner image is exposed is in the ultraviolet wavelength range (UV range).

10. Process as claimed in claim 5, wherein the energy of the first radiation pulse is greatest, and wherein the energy of each additional subsequent pulse is smaller than the energy of the radiation pulse which was applied just before to the toner image.

11. Digital image recording device (1), especially electrographic or electrophotographic printing or copying machine, with a fixing device (3) for fixing a toner image on an image carrier substrate (9), the fixing device (3) comprising:

at least one roller (7) via which the image carrier substrate (9) is guided, the roller (7) is made drum-shaped and at least its jacket (11) includes transparent material having a high thermal conductivity, and in the interior (19) of the roller (7) there is a radiation source (17) for exposing the toner image to electromagnetic radiation in the UV range; and a control for activating said radiation source (17) whereby the toner image is melted to such an extent that a relatively high gloss results when the toner image is first fixed to the image carrier substrate (9), and after the toner image has been fixed on the image carrier substrate (9), the toner image is exposed to so much thermal energy by electromagnetic radiation or several radiation pulses from the radiation source (17) that at least parts of the toner material, especially the surface layer of the toner image, are overheated and thus damaged in a controlled manner, as much heat being supplied to the toner image at least once again that the toner image on its surface or in the area near its surface is melted either completely or at least in areas, the degree and/or the duration of melting being set depending on the desired gloss of the toner image.

* * * * *